US005520510A

United States Patent [19]

Deussen

[11] Patent Number: 5,520,510

[45] Date of Patent: May 28, 1996

[54] MECHANISM FOR PREVENTING BACK-FLOW FOR PUMP DISCHARGE PIPES

[75] Inventor: Manfred Deussen, Bremen, Germany

[73] Assignee: KSB Aktiengesellschaft, Frankenthal, Germany

[21] Appl. No.: 224,636

[22] Filed: Apr. 6, 1994

[30] Foreign Application Priority Data

| | | | |
|---|---|---|---|
| Apr. 8, 1993 | [DE] | Germany | 43 11 745.7 |
| Jun. 21, 1993 | [DE] | Germany | 43 20 422.8 |

[51] Int. Cl.[6] ..... F01D 17/00

[52] U.S. Cl. ..... 415/146; 415/24

[58] Field of Search ..... 415/24, 146, 913

[56] References Cited

U.S. PATENT DOCUMENTS

| | | | |
|---|---|---|---|
| 1,003,905 | 9/1911 | Hill | 415/913 |
| 2,211,526 | 8/1940 | Storey | 415/146 |
| 3,174,434 | 3/1965 | Schieve | 415/146 |
| 3,251,303 | 5/1966 | Mason et al. | 415/24 |

FOREIGN PATENT DOCUMENTS

| | | | |
|---|---|---|---|
| 166599 | 8/1950 | Austria | 415/913 |
| 0118403B1 | 2/1984 | European Pat. Off. . | |
| 274394 | 5/1914 | Germany . | |
| 362696 | 10/1922 | Germany . | |
| 543770 | 2/1932 | Germany | 415/913 |
| 659106 | 3/1938 | Germany . | |

*Primary Examiner*—John T. Kwon
*Attorney, Agent, or Firm*—Darby & Darby

[57] ABSTRACT

A mechanism for preventing back-flow for a discharge pipe of a pump. The discharge pipe terminates in a container and essentially runs vertically upward. A bell-shaped hood is turned over the exit opening of the discharge pipe so as to form a low-loss siphon. At least one venting apparatus is connected to one of the discharge pipe and the hood.

7 Claims, 2 Drawing Sheets

MECHANISM FOR PREVENTING BACK-FLOW FOR PUMP DISCHARGE PIPES

FIELD OF THE INVENTION

The present invention relates to a mechanism for preventing back-flow at the discharge pipe of a pump, such that the discharge pipe, which is disposed essentially vertical and through which the medium flows from the bottom to the top, empties into a container.

BACKGROUND OF THE INVENTION

The discharge opening of a pump, which transports medium into a container, should be at a slightly higher level than the highest possible liquid level in the container. Besides the overflow height at the pipe exit, there must also be a portion of the transport height which assures that return flow of the medium will be prevented, so that, upon stoppage of the pump, medium cannot flow back from the container through the pump. Furthermore, if the fill level in the container is variable, more losses occur, which lead to uneconomical operation.

EP-PS 0 118 403 discloses a proposed solution in which the discharge pipe of the pump is equipped with a telescope-like pipe. By means of a float which surrounds the discharge opening, the telescope-like pipe can float on the liquid surface and thus can adapt to the water level. In theory this proposed solution may be a good proposal, however, due to contaminations present in the transported medium and due to problems which may arise in connection with the displacement mechanism, in actual practice this proposal is afflicted with considerable risks in terms of operational reliability. In the introduction to the description, this document also mentions another proposed solution, namely to bend the discharge pipe in the manner of a siphon, so that the upper section of the pipe will always be disposed above the liquid level in the container. However, since such a siphon has great losses, problems can occur when the pump is started.

SUMMARY OF THE INVENTION

It is an object of the present invention to create an energy-saving, operationally reliable design for a pump discharge, which is inexpensive to produce.

The pump discharge pipe is disposed so that it extends beyond the highest water level. The pump discharge pipe outlet is covered by a bell-shaped hood, whose lower edge extends to the lowest water level. This arrangement provides, in a very simple fashion, a discharge arrangement with a good flow and with energy recovery capabilities. Since the pump discharge is designed so as to be always open, flow losses are obviated, such as could occur, for example, through check valves which close the discharge. No additional fall losses occur in the case of variable fill levels, especially if the fill level is falling. The bell-shaped hood can easily be realized by a curved bottom or by another form which is economical to manufacture. A pipe segment, disposed at a distance from and coaxial with the pump shaft pipe, connects to the edge of the bell-shaped hood. This pipe section forms the edge of the bell, and its length corresponds at least to the possible variations of the fill level. In contrast to the known, above-mentioned types of discharge structures, the coaxial siphon formed in this way minimizes the flow losses and also has the required operational reliability.

When the pump is shut off, the venting apparatus vents the coaxial siphon and prevents back-flow from the container. It should also be noted that this solution is independent of the construction type of the pump. For example, the discharge pipe can be part of a pump shaft which accommodates a submersible motor-driven pump or a component of the discharge pipe of a vertical shaft pump or well pump.

According to one variation of the present invention, the bell-shaped hood is disposed so as to be axially displaced relative to the discharge pipe. By means of this measure, it is possible to determine in advance the main outflow direction of the siphon. This can be an advantage if the discharge pipe is disposed in the vicinity of a lateral wall surface of a basin. Interferences with the flow resulting from the wall surface thus can be compensated by the axial displacement of the bell-shaped hood.

According to another variation of the present invention, the venting apparatus is designed as a controlled apparatus or as an apparatus that can be influenced by the transport medium. Various forms of venting apparatuses can be used. A mechanism which reacts to external influences here can control the function of the venting apparatus. The venting apparatus, which can be influenced by the transport medium, reacts to the pressure conditions and/or the flow conditions within the mechanism for preventing back-flow. This can involve various known types of fittings or venting apparatuses, which have no moving parts, and depend only on the surface ratios of vent pipes and openings.

According to another variation of the present invention, the venting apparatus can be controlled by the electrical and/or mechanical behavior of the pump driving-motor. Thus, for example, by monitoring the rpm or the current consumption of a motor, it can be determined whether the siphon is being vented in an undesirable manner. Sudden changes of these variables would lead to this conclusion.

Another variation of the present invention employs soft-seal fittings as the venting apparatus. These fittings can be influenced by the flow. Because of the soft seal, they have the advantage of noiseless operation, as well as of reliable function, even if the transport medium contains contaminations. Depending on the venting apparatus chosen, they, as well as the venting apparatus itself can be disposed at various points on the hood or on the discharge pipe (only two locations for the venting apparatus are shown in FIG. 1 for the sake of clarity). The point that is chosen depends on the construction type and on the manner in which it is desired to interrupt the back-flow. When the pump is shut off, and thus when the flow stops and begins to return, these fittings or venting apparatuses open and vent the siphon. This terminates the lifting effect and, effectively prevents back-flow.

According to additional variations of the present invention, the venting apparatus is designed as an open pipe. This pipe extends in correspondence with the direction of the discharge pipe. Besides offering the advantage of economical manufacture, this solution is distinguished by the absence of moving parts which could be prone to trouble. No maintenance is required either, since contaminations which may possibly settle inside the pipe are suctioned off during the venting process. The pipe which functions as the venting apparatus has a cross-section of such a size and is installed at such a point that outside air is excluded when the pump is operating and reliable venting is guaranteed when the pump is shut off.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENT INVENTION

Figure 1:
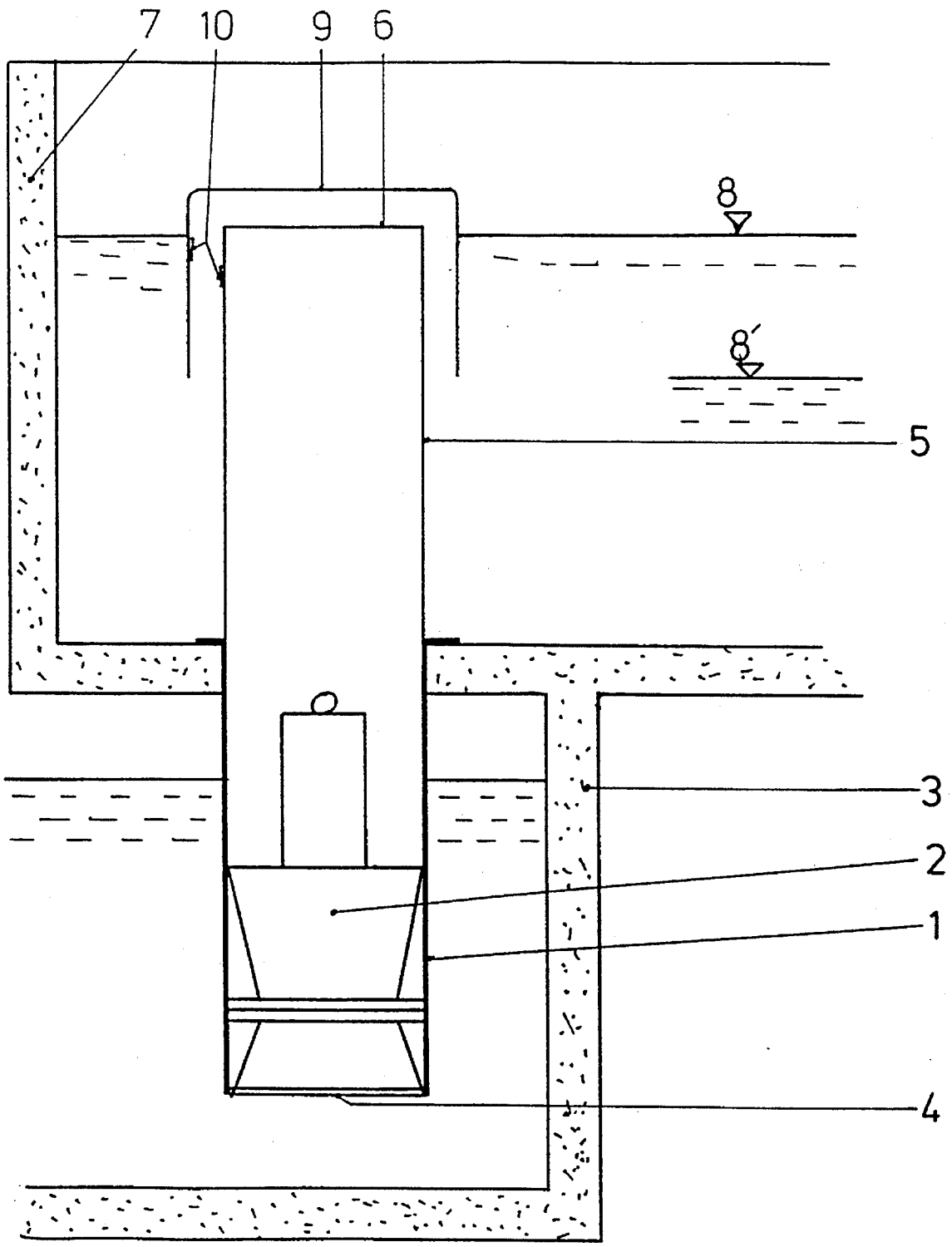
FIG. 1 shows a sectional view of the venting apparatus.

Referring now to FIG. 1, a pump 2 is installed within a shaft pipe 1. The shaft pipe 1, with the pump 2, extends into a container 3, from which water is suctioned through an inlet opening 4. The pump 2 transports the medium through the shaft pipe 1 into a discharge pipe 5, from which it flows though an outlet opening 6 into a container 7. The liquid level in the container can reach a maximum liquid level 8 and a minimum liquid level 8'. A bell-shaped hood 9 is turned over the exit opening 6 of the discharge pipe 5, so that a siphon is created in the area of the exit opening 6. This siphon can be coaxial or also axially displaced relative to the two parts which form the siphon. The latter design makes it possible to predetermine a preferred outflow direction. This results in an arrangement with a flow-promoting outlet for energy-saving pump operation. This solution also involves a minimum of investment cost, since simple, pre-fabricated parts or so-called semi-finished products can be used.

As one of several possible venting apparatuses 10, fittings are arranged here by way of example. The exiting medium presses these into their closure position, and they are of such a nature that they open when the flow reverses and thus vent the interior of the hood 9. This would immediately stop the lifting action and thus prevent a back-flow. Soft-sealing check valves suggest themselves as a simple solution for these fittings.

Figure 2:
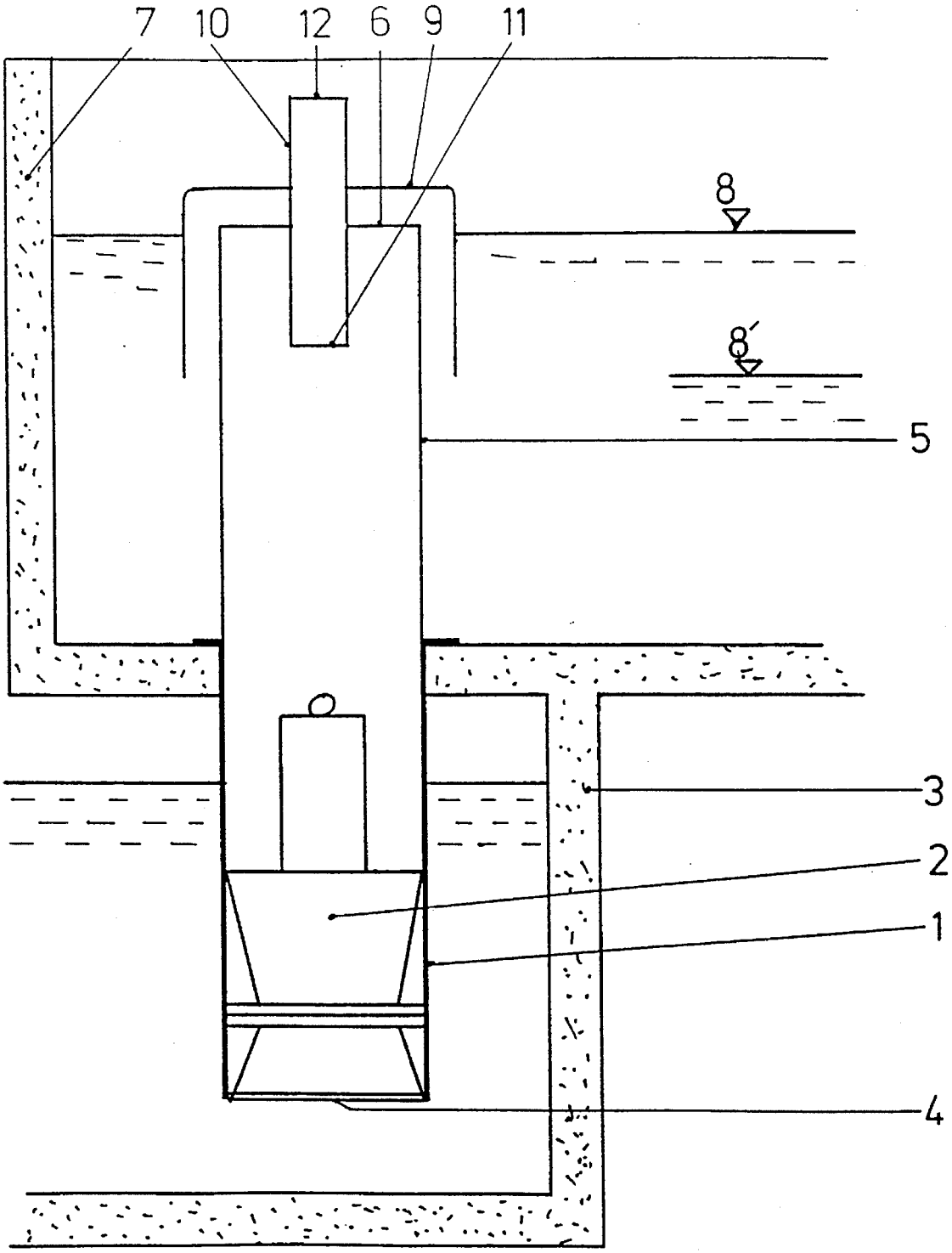
FIG. 2 shows a sectional view of an open vent pipe as the venting apparatus.

In FIG. 2, an open vent pipe 10 is used as venting apparatus. In the representation shown here, vent pipe 10 is fastened air-tight and vertically in the hood 9. The height of the fastening can be fixed or adjustable. The wall opening 11 of the vent pipe here terminates inside the discharge pipe 5, and the upper opening 12 here is situated above the maximum liquid level 8. The length and cross-sections of this type of venting apparatus 10 are dimensioned so as to match the operating data of the system. Between the maximum and minimum operating points of the pump 2, the venting apparatus 10 is indeed filled with liquid, but the liquid cannot exit from the pipe. The reason for this is that the upper opening 12 is situated above the pressure level that establishes itself. During normal operation, a liquid level will establish itself inside the pipe above the edge of the lower opening 11 so as to secure the reliable exclusion of atmospheric air.

While the pump is starting up, liquid can exit from the upper opening 12, and in particular this can happen until the entire system is completely filled or vented. In order to deflect liquid which may possibly exit during the start-up process, it is possible to dispose a hood above the upper opening 12. This hood is then arranged so that the full cross-section to the outside air remains preserved.

While the pump is operating, the liquid level inside the venting apparatus 10 rises above the outer liquid levels 8, 8'. Consequently, air is prevented from gaining access into the siphon through the lower opening 11 of the vent pipe. When the pump is shut off, the flow reverses. This results in an under-pressure at the lower opening 11 relative to the atmospheric pressure and the outer liquid level. This under-pressure causes air to flow into the siphon so as to vent it, and consequently prevents back-flow of the medium.

Of course it is also possible to dispose the venting apparatus 10 at another place than the one shown here. The only decisive factor being the height of the openings 11, 12.

From the foregoing description, it will be appreciated that the present invention makes available, a compact, cost efficient "Mechanism for Preventing Back Flow at the Discharge of a Pump".

Having described the presently preferred exemplary embodiment of a new and improved "Mechanism for Preventing Back Flow at the Discharge of a Pump" in accordance with the present invention, it is believed that other modifications, variations and changes will be suggested to those skilled in the art in view of the teachings set forth herein. It is, therefore, to be understood, that all such variations, modifications, and changes are believed to fall within the scope of the present invention as defined by the appended claims.

What is claimed is:

1. A mechanism for preventing back-flow at the discharge pipe of a pump comprising:

a pump having an inlet and an outlet;

a discharge pipe having an inlet and an outlet, said discharge pipe inlet being connected, to said pump outlet, said discharge pipe being disposed, substantially vertically and through which the medium flows from the inlet disposed at a bottom of said discharge pipe to the outlet disposed at a top of said discharge pipe, a container, which contains the medium, a bell-shaped hood being turned over and is disposed adjacent to the discharge pipe outlet;

at least one venting apparatus being connected to one of said discharge pipe and said hood.

2. The mechanism for preventing back-flow according to claim 1, wherein the bell-shaped hood is axially displaced with respect to the discharge pipe.

3. The mechanism for preventing back-flow, according to claim 1, wherein the venting apparatus is actuated by the medium.

4. The mechanism for preventing back-flow, according to claim 3, wherein the venting apparatus is controlled by the pump drive-motor.

5. The mechanism for preventing back-flow according to claim 1, wherein the venting apparatus are soft-sealing fittings.

6. The mechanism for preventing back-flow, according to claim 3, wherein the pump is disposed in a first container and the discharge pipe outlet is disposed in a second container, the venting apparatus is an open pipe having a lowermost opening terminating inside the discharge pipe and having an uppermost opening terminating above a maximum liquid level in said second container.

7. The mechanism for preventing back-flow according to claim 6, wherein the tubular venting apparatus is fastened to the bell-shaped hood.

* * * * *